US009371499B2

(12) United States Patent
Suen et al.

(10) Patent No.: US 9,371,499 B2
(45) **Date of Patent: *Jun. 21, 2016**

(54) FRICTION MODIFIERS AND A METHOD OF MAKING THE SAME

(71) Applicants: Yat Fan Suen, Martinez, CA (US); Francois Simard, Novato, CA (US); Rachel M. Knight, Hercules, CA (US); John K. Ward, Concord, CA (US)

(72) Inventors: Yat Fan Suen, Martinez, CA (US); Francois Simard, Novato, CA (US); Rachel M. Knight, Hercules, CA (US); John K. Ward, Concord, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 240 days.

This patent is subject to a terminal disclaimer.

(21) Appl. No.: 13/663,748

(22) Filed: Oct. 30, 2012

(65) Prior Publication Data

US 2014/0121141 A1 May 1, 2014

(51) Int. Cl.
*C10M 139/00* (2006.01)
*C10M 159/12* (2006.01)

(52) U.S. Cl.
CPC ..... *C10M 159/12* (2013.01); *C10M 139/00* (2013.01); *C10M 2209/084* (2013.01); *C10M 2223/045* (2013.01); *C10M 2227/061* (2013.01); *C10N 2230/06* (2013.01); *C10N 2230/54* (2013.01); *C10N 2240/10* (2013.01); *C10N 2240/102* (2013.01); *C10N 2270/02* (2013.01)

(58) Field of Classification Search
CPC ..... C10M 133/16; C10M 133/18
USPC ..... 508/194, 195
See application file for complete search history.

(56) References Cited

U.S. PATENT DOCUMENTS

| | | | | |
|---|---|---|---|---|
| 3,011,880 | A | 12/1961 | Chien-Wei et al. | |
| 4,046,802 | A | 9/1977 | Elliott et al. | |
| 4,085,126 | A | 4/1978 | McConnell et al. | |
| 4,116,986 | A | 9/1978 | Bistline, Jr. et al. | |
| 4,231,883 | A | 11/1980 | Malec | |
| 4,331,545 | A | 5/1982 | Papay et al. | |
| 4,382,006 | A | 5/1983 | Horodysky | |
| 4,389,322 | A | 6/1983 | Horodysky | |
| 4,406,802 | A | 9/1983 | Horodysky | |
| 4,478,732 | A * | 10/1984 | Horodysky et al. | 508/190 |
| 4,507,216 | A | 3/1985 | Braid et al. | |
| 5,034,447 | A | 7/1991 | Izumida et al. | |
| 6,245,725 | B1 | 6/2001 | Tanaka et al. | |
| 6,803,350 | B2 * | 10/2004 | Lantuejoul et al. | 508/487 |
| 7,691,794 | B2 | 4/2010 | Muir | |
| 2005/0107623 | A1 | 5/2005 | Fox et al. | |
| 2006/0019838 | A1 | 1/2006 | Muir | |
| 2007/0155631 | A1 * | 7/2007 | Muir | 508/185 |
| 2012/0129743 | A1 | 5/2012 | Suen | |

FOREIGN PATENT DOCUMENTS

| | | | |
|---|---|---|---|
| CN | 102702009 | A | 10/2012 |
| EP | 393748 | | 10/1990 |
| JP | 2005320441 | | 11/2005 |
| WO | 2012071185 | A2 | 5/2012 |

OTHER PUBLICATIONS

Khanmohammadi, M. et al. "Quantitative Monitoring of the Amidation Reaction Between Coconut Oil and Diethanolamine by Attenuated Total Reflectance Fourier Transform Infrared Spectrometry," Journal of Surfactants and Detergents, Dec. 28, 2008, vol. 12, Issue 1; p. 38, Scheme 1; p. 37, Paragraph 3.

* cited by examiner

*Primary Examiner* — Prem C Singh
*Assistant Examiner* — Francis C Campanell
(74) *Attorney, Agent, or Firm* — M. Carmen & Associates, PLLC

(57) ABSTRACT

A lubricating oil additive composition comprising the reaction product of a (a) nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester; (b) a source of boron; and (c) a hydrocarbyl polyol, having at least three hydroxyl groups.

24 Claims, No Drawings

FRICTION MODIFIERS AND A METHOD OF MAKING THE SAME

FIELD OF THE INVENTION

This invention relates to new lubricating oil additives and lubricating oil compositions comprising the new lubricating oil additives. More specifically, it relates to passenger car engines and heavy duty diesel engines having lubricating oil compositions containing a friction reducing component comprising nitrogen-containing reactant that is co-borated with an hydrocarbyl polyol having at least three hydroxyl groups.

BACKGROUND OF THE INVENTION

In the realm of friction modifiers used in passenger car motor oils, there are many options. One of the many options available as an engine oil friction modifier is bis-ethoxy oleylamine which has been used for a number of years as a friction modifier.

Until recently, diesel engine oil formulators focused on the problem of maximizing the useful life of a lubricant and the engine it is used in. This has been done with the aid of wear inhibitors and antioxidants. Formulators had not spent too much time on tuning an engine oil's characteristics in order to maximize fuel economy.

A number of factors have contributed to the recent interest in improving diesel engine fuel economy. Global climate change legislation has slowly but steadily been limiting emissions from diesel engines. In addition, the price of crude oil skyrocketed in 2008. Suddenly fuel costs had superseded labor costs as the single largest expense of many truck fleets. Although the price of crude has dropped off significantly from where it peaked at $145/barrel in 2008, fuel economy is firmly established as an important issue for OEMs, diesel engine owners and diesel engine oil producers.

Addressing fuel economy in heavy duty diesel engines in a manner parallel to that used in passenger car engines has proven to not be the best strategy. Friction modifiers that have been used with success in passenger car engine oils show disappointing results in diesel engines. Reducing friction by reducing the viscosity of the oil has lead to wear issues. Obviously, a new approach is needed to tackle the problem of fuel economy in diesel engines.

New organic friction modifiers (OFMs) designed to function in both passenger car and heavy duty diesel engine oils have begun to emerge. Surprising benefits in friction reduction have been seen with a new class of mixed borate esters of bis-ethoxy alkylamines/amides. These benefits have been demonstrated through both bench and engine testing.

Malec, U.S. Pat. No. 4,231,883 teaches the use of alkoxylated hydrocarbyl amines as friction modifiers.

Chien-Wei et al., U.S. Pat. No. 3,011,880 teaches the use of borate esters of bis alkoxylated hydrocarbyl amides as fuel additives to improve resistance to deposits and low temperature operation.

Colombo, EP393748 teaches the use of borate esters of mono and bis-ethoxylated alkyl amides as friction modifiers and anti corrosion agents in lubricants.

Papay et al., U.S. Pat. No. 4,331,545 teaches the use of borate esters of monoethoxylated hydrocarbyl amides as friction modifiers for both lubricants and fuels. Mixed borate esters with alkyl alcohols and polyhydric alcohols are described.

Horodysky, U.S. Pat. No. 4,382,006 teaches the use of borate esters of bis-ethoxylated alkyl amines as friction modifiers for lubricants. Example borate esters are mixed esters with butanol.

Horodysky, U.S. Pat. No. 4,389,322 teaches the use of borate esters of bis-ethoxylated alkyl amides as friction modifiers for lubricants. Example borate esters are mixed esters with butanol.

Horodysky et al., U.S. Pat. No. 4,406,802 teaches the use of mixed borate esters of compounds including bis-alkoxylated alkyl amines, bis-alkoxylated alkyl amides and alcohol hydroxyesters as friction modifiers in lubricants.

Horodysky et al., U.S. Pat. No. 4,478,732 teaches the use of mixed borate esters of compounds including bis-alkoxylated alkyl amines, bis-alkoxylated alkyl amides and alcohol hydroxyesters as friction modifiers in lubricants.

Yasushi, JP2005320441 teaches the use of a mixed borate ester of bis-ethoxylated alkyl amides and glycerol monoesters in low sulfur formulations as antiwear additives.

None of the lubricants previously described address the problem of friction modification in a diesel engine oil with a mixed borate ester incorporating an hydrocarbyl polyol having at least three hydroxyl groups.

SUMMARY OF THE INVENTION

An embodiment of the present invention is directed to a lubricating oil additive composition comprising the reaction product of a (a) nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester; (b) a source of boron; and (c) a hydrocarbyl polyol, having at least three hydroxyl groups.

An embodiment of the present invention is directed to a lubricating oil composition comprising (A) major amount of an oil of lubricating viscosity and (B) a lubricating oil additive composition comprising the reaction product of (i) nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester, (ii) a source of boron, and (iii) a hydrocarbyl polyol, having at least three hydroxyl groups.

An embodiment of the present invention is directed to a method for reducing friction in an internal combustion engine comprising lubricating said engine with a lubricating oil composition comprising the lubricating oil composition comprising (A) major amount of an oil of lubricating viscosity and (B) a lubricating oil additive composition comprising the reaction product of (i) nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester, (ii) a source of boron, and (iii) a hydrocarbyl polyol, having at least three hydroxyl groups.

An embodiment of the present invention is directed to a lubricating oil additive concentrate comprising from about 90 wt. % to about 10 wt. % of an organic liquid diluent and from about 10 wt. % to about 90 wt. % of a lubricating oil additive composition comprising the reaction product of a (a) nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester; (b) a source of boron; and (c) a hydrocarbyl polyol, having at least three hydroxyl groups.

An embodiment of the present invention is directed to a method of preparing a lubricating oil additive composition comprising reacting (a) nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester; (b) a source of boron; and (c) a hydrocarbyl polyol, having at least three hydroxyl groups.

DETAILED DESCRIPTION OF THE INVENTION

While the invention is susceptible to various modifications and alternative forms, specific embodiments thereof and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

Definitions

The following terms will be used throughout the specification and will have the following meanings unless otherwise indicated.

The term "polyamines" refers to organic compounds containing more than one basic nitrogen. The organic portion of the compound may contain aliphatic, cyclic, or aromatic carbon atoms.

The term "polyalkyleneamines" or "polyalkylenepolyamines" refers to compounds represented by the general formula $$H_2N(—R—NH)_n—H$$

wherein R is an alkylene group of preferably 2-3 carbon atoms and n is an integer of from about 1 to 11.

The term "amide" or "polyamide" refers to the reaction product of a carboxylic acid, carboxylate, anhydride of a carboxylic acid, or ester of a carboxylic acid and an amine, including polyamine.

The term "carboxylic acid component" refers to carboxylic acids, carboxylates, carboxylic anhydrides, and the esters of carboxylic acids.

Lubricating Oil Additive

In one embodiment, the lubricating oil additive is the reaction product of a nitrogen-containing reactant, such as an alkyl alkanolamide, an alkoxylated alkyl alkanolamide, an alkyl alkanolamine or an alkoxylated alkyl alkanolamine; a boron containing component, such as boric acid; and a hydrocarbyl polyol having at least three hydroxyl groups.

Nitrogen-Containing Reactant

Alkanolamides

In one embodiment, the nitrogen-containing reactant is an alkyl monoalkanolamide or an alkyl dialkanolamide. Such alkyl monoalkanolmides and alkyl dialkanolamides include, but are not limited to, monoethanolamides derived from coconut oil or cocomonoethanolamide, diethanolamides derived from coconut oil, lauric myristic diethanolamide, lauric monoethanolamide, lauric diethanolamide and lauric monoisopropanolamide. Typically, the alkyl group in coconut oil comprises a mixtures of caprylic, capric, lauric, myristic, palmitic, stearic, oleic and linoleic Typically, alkyl monoalkanolamides and alkyl dialkanolamides are prepared by reacting carboxylic acids and esters with monoalkanolamines and dialkanolamines Alkyl mono- and di-alkanolamides may be prepared from individual $C_8$-$C_{18}$ carboxylic acids—such as myristoleic acid, palmitoleic acid, oleic acid, linolenic acid, caproic acid, caprylic acid, capric acid, lauric acid, myristic acid, palmitic acid, stearic acid, arachidic acid, behenic acid, lignoceric acid, and the like—or their methyl esters as, for example, decanoic, lauric, myristic, palmitic, stearic, and oleic, or mixtures of alkyls such as those derived from animal fats or vegetable oils, that is, tallow, coconut oil, palm oil, palm kernel oil, fish oils, etc. These can readily be reacted with a variety of alkanolamines such as, for example, monoethanolamine, mono-n-propanolamine, monoisopropanolamine, dialkanolamines, diglycolamine (2-(2-aminoethoxy)ethanol), 3-hydroxy-1-amino-butane, 4-hydroxy-1-amino butane, or amino-cyclohexanol, to produce the desired alkyl alkanolamides. The alkyl alkanolamides may be prepared according to methods that are well known in the art, including, but not limited to, the process described in U.S. Pat. Nos. 4,085,126; 4,116,986.

In one embodiment, the nitrogen-containing reactant is an alkyl alkanolamide having following structure:

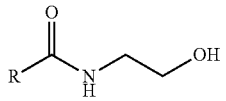

(I)

wherein R comprises 6 to 22 carbon atoms; preferably, where in R comprises from about 8 to about 18 carbon atoms; and, more preferred, wherein R comprises 12 carbon atoms.

In one embodiment, the nitrogen-containing reactant is an alkyl dialkanolamide having the following structure:

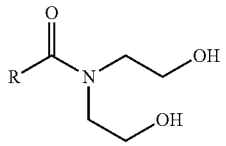

(II)

wherein R comprises 6 to 22 carbon atoms; preferably, where in R comprises from about 8 to about 18 carbon atoms; and, more preferred, wherein R comprises 12 carbon atoms.

In one embodiment, the nitrogen-containing reactant is an alkoxylated alkyl alkanolamide. The alkoxylated moiety may be ethoxylated, propoxylated, butoxylated and the like.

The alkyl moiety of the alkoxylated alkyl alkanolamide is preferably a branched or straight chain, alkyl or alkenyl group containing 3 to 21 carbon atoms, more preferably containing 8 to 18 carbon atoms, or combinations thereof. The alkoxy moiety may be an ethoxy, propoxy, or butoxy group, or combinations thereof. In a preferred embodiment propoxylated alkyl alkanolamides, more preferably propoxylated alkyl ethanolamides are employed.

Alkoxylated alkyl alkanolamides represented by the following structure:

(III)

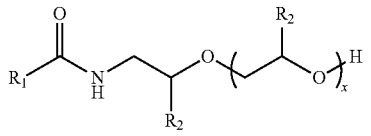

where $R^1$ is a branched or straight chain, saturated or unsaturated $C_3$-$C_{21}$ alkyl radical, preferably a $C_8$-$C_{18}$ alkyl radical, or a combination thereof; $R^2$ is a hydrogen, or $C_1$-$C_2$ alkyl radical or a combination thereof, preferably $R^2$ is either hydrogen or a $C_1$ alkyl radical; x is from about 1 to about 8, preferably about 1 to about 5, and more preferably from about 1 to about 3.

Examples of useful alkoxylated-alkyl alkanolamides include polyoxypropylene-, polyoxybutylene-, alkyl ethanolamides or alkyl isopropanolamides. Alkoxylated alkyl ethanolamides are preferred, particularly propoxylated alkyl ethanolamides. The alkyl ethanolamide moiety is preferably an alkyl monoethanolamide, and more preferably is derived from lauric monoethanolamide, capric monoethanolamide, caprylic monoethanolamide, caprylic/capric monoethanolamide, decanoic monoethanolamide, myristic monoethanolamide, palmitic monoethanolamide, stearic monoethanolamide, isostearic monoethanolamide, oleic monoethanolamide, linoleic monoethanolamide, octyidecanoic monoethanolamide, 2-heptylundecanoic monoethanolamide, alkyl monoethanolamide derived from coconut oil, alkyl monoethanolamide derived from beef tallow, alkyl monoethanolamide derived from soy bean oil and alkyl monoethanolamide derived from palm kernel oil. Of these capryl, linoleyl, stearic, isostearic, and those derived from soy bean oil or coconut oil are preferred.

Preferred propoxylated fatty ethanolamides include propoxylated hydroxyethyl caprylamides, propoxylated hydroxyethyl cocamides, propoxylated hydroxyethyl linoleamides, propoxylated hydroxyethyl isostearamides, and combinations thereof. Propoxylated hydroxyethyl cocamides are more preferred. Preferred specific materials are PPG-1 hydroxyethyl caprylamide, PPG-2 hydroxyethyl cocamide, PPG-3 hydroxyethyl linoleamide, PPG-2 hydroxyethyl isostearamide, and combinations thereof PPG-2 hydroxyethyl cocamide is particularly preferred.

In an alternative embodiment, alkoxylated alkyl isopropanolamides are employed.

The alkyl isopropanolamide moiety is preferably an alkyl monoisopropanolamide, and more preferably is derived from lauric monoisopropanolamide, capric monoisopropanolamide, caprylic monoisopropanolamide, caprylic/capric monoisopropanolamide, decanoic monoisopropanolamide, myristic monoisopropanolamide, palmitic monoisopropanolamide, stearic monoisopropanolamide, isostearic monoisopropanolamide, oleic monoisopropanolamide, linoleic monoisopropanolamide, octyldecanoic monoisopropanolamide, 2-heptylundecanoic monoisopropanolamide, alkyl monoisopropanolamide derived from coconut oil, alkyl monoisopropanolamide derived from beef tallow, monoisopropanolamide derived from soy bean oil, and alkyl monoisopropanolamide derived from palm kernel oil.

Alkoxylated alkyl dialkanolamides represented by the following structure:

(IV)

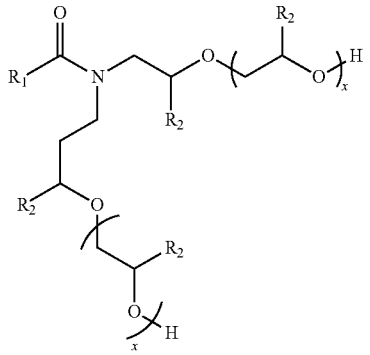

where $R^1$ is a branched or straight chain, saturated or unsaturated $C_3$-$C_{21}$ alkyl radical, preferably a $C_8$-$C_{18}$ alkyl radical, or a combination thereof; $R^2$ is a hydrogen or a $C_1$-$C_2$ alkyl radical or a combination thereof, preferably $R^2$ is a hydrogen or a $C_1$ alkyl radical; x is from about 1 to about 8, preferably about 1 to about 5, and more preferably from about 1 to about 3.

Examples of useful alkoxylated-alkyl dialkanolamides include polyoxypropylene-, polyoxybutylene-, alkyl diethanolamides or alkyl diisopropanolamides. Alkoxylated alkyl diethanolamides are preferred, particularly propoxylated alkyl diethanolamides. The alkyl diethanolamide moiety is preferably an alkyl diethanolamide, and more preferably is derived from lauric diethanolamide, capric diethanolamide, caprylic diethanolamide, caprylic/capric diethanolamide, decanoic diethanolamide, myristic diethanolamide, palmitic diethanolamide, stearic diethanolamide, isostearic diethanolamide, oleic diethanolamide, linoleic diethanolamide, octyidecanoic diethanolamide, 2-heptylundecanoic diethanolamide, alkyl diethanolamide derived from coconut oil, alkyl diethanolamide derived from beef tallow, alkyl diethanolamide derived from soy bean oil and alkyl diethanolamide derived from palm kernel oil. Of these capryl, linoleyl, stearic, isostearic, and those derived from soy bean oil or coconut oil are preferred.

Preferred propoxylated fatty diethanolamide include propoxylated bisethoxy caprylamides, propoxylated bisethoxy cocamides, propoxylated bisethoxy linoleamides, propoxylated bisethoxy isostearamides, and combinations thereof. Propoxylated bisethoxy cocamides are more preferred. Preferred specific materials are PPG-1 bisethoxy caprylamide, PPG-2 bisethoxy cocamide, PPG-3 bisethoxy linoleamide, PPG-2 bisethoxy isostearamide, and combinations thereof PPG-2 bisethoxy cocamide is particularly preferred.

In an alternative embodiment, alkoxylated alkyl diisopropanolamides are employed. The alkyl isopropanolamide moiety is preferably an alkyl diisopropanolamide, and more preferably is derived from lauric diisopropanolamide, capric diisopropanolamide, caprylic diisopropanolamide, caprylic/capric diisopropanolamide, decanoic diisopropanolamide, myristic diisopropanolamide, palmitic diisopropanolamide, stearic diisopropanolamide, isostearic diisopropanolamide, oleic diisopropanolamide, linoleic diisopropanolamide, octyldecanoic diisopropanolamide, 2-heptylundecanoic diisopropanolamide, alkyl diisopropanolamide derived from coconut oil, alkyl diisopropanolamide derived from beef tallow, diisopropanolamide derived from soy bean oil, and alkyl diisopropanolamide derived from palm kernel oil.

Alkanolamines

In one embodiment, the nitrogen-containing reactant is an alkyl alkanolamine having one of the following structures:

(I)

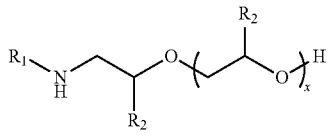

(II)

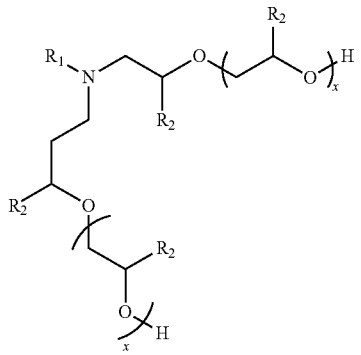

wherein $R^1$ is a branched or straight chain, saturated or unsaturated $C_3$-$C_{21}$ alkyl radical, preferably a $C_8$-$C_{18}$ alkyl radical, or a combination thereof; $R^2$ is a hydrogen or a $C_1$-$C_2$ alkyl radical or a combination thereof, preferably $R^2$ is a hydrogen or a $C_1$ alkyl radical; x is from about 1 to about 8, preferably about 1 to about 5, and more preferably from about 1 to about 3.

In one embodiment, the nitrogen-containing reactant is an alkyl monoalkanolamine or an alkyl dialkanolamine. Such alkyl monoalkanolamine and alkyl dialkanolamine include, but are not limited to, monoethanolamine derived from coconut oil or cocomonoethanolamine, diethanolamine derived from coconut oil, lauric myristic diethanolamine, lauric monoethanolamine, lauric diethanolamine and lauric monoisopropanolamine. Typically, the alkyl group in coconut oil comprises mixtures of caprylic, capric, lauric, myristic, palmitic, stearic, oleic and linoleic Typically, alkyl monoalkanolamines and alkyl dialkanolamines are commercially available from Akzo Nobel.

Examples of alkyl alkanolamines include but are not limited to the following:

Oleyl diethanolamine, diethanolamine derived from coconut oil and diethanolamine derived from beef tallow and the like.

Examples of useful alkoxylated-alkyl dialkanolamines include polyoxypropylene-, polyoxybutylene-, alkyl diethanolamines or alkyl diisopropanolamines. Alkoxylated alkyl diethanolamines are preferred, particularly propoxylated alkyl diethanolamines The alkyl diethanolamine moiety is preferably an alkyl diethanolamine, and more preferably is derived from lauric diethanolamine, capric diethanolamine, caprylic diethanolamine, caprylic/capric diethanolamine, decanoic diethanolamine, myristic diethanolamine, palmitic diethanolamine, stearic diethanolamine, isostearic diethanolamine, oleic diethanolamine, linoleic diethanolamine, octyidecanoic diethanolamine, 2-heptylundecanoic diethanolamine, alkyl diethanolamine derived from coconut oil, alkyl diethanolamine derived from beef tallow, alkyl diethanolamine derived from soy bean oil and alkyl diethanolamine derived from palm kernel oil. Of these capryl, linoleyl, stearic, isostearic, and those derived from soy bean oil or coconut oil are preferred.

Preferred propoxylated fatty diethanolamine include propoxylated bisethoxy caprylamines, propoxylated bisethoxy cocamines, propoxylated bisethoxy linoleamines, propoxylated bisethoxy isostearamines, and combinations thereof. Propoxylated bisethoxy cocamines are more preferred. Preferred specific materials are PPG-1 bisethoxy caprylamine, PPG-2 bisethoxy cocamine, PPG-3 bisethoxy linoleamine, PPG-2 bisethoxy isostearamine, and combinations thereof PPG-2 bisethoxy cocamine is particularly preferred.

In an alternative embodiment, alkoxylated alkyl diisopropanolamines are employed. The alkyl isopropanolamine moiety is preferably an alkyl diisopropanolamine, and more preferably is derived from lauric diisopropanolamine, capric diisopropanolamine, caprylic diisopropanolamine, caprylic/capric diisopropanolamine, decanoic diisopropanolamine, myristic diisopropanolamine, palmitic diisopropanolamine, stearic diisopropanolamine, isostearic diisopropanolamine, oleic diisopropanolamine, linoleic diisopropanolamine, octyldecanoic diisopropanolamine, 2-heptylundecanoic diisopropanolamine, alkyl diisopropanolamine derived from coconut oil, alkyl diisopropanolamine derived from beef tallow, diisopropanolamine derived from soy bean oil, and alkyl diisopropanolamine derived from palm kernel oil.

The nitrogen-containing reactant may be prepared by methods that are well known in the art. Alkyl alkanolamides and alkyl alkanolamines may be prepared according to U.S. Pat. Nos. 4,085,126; 7,479,473 and other methods that are well known in the art; or, they may be purchased from Akzo Nobel.

Source of Boron Reactant

In one embodiment a source of boron such as boron trioxide or any of the various forms of boric acid—including meta-boric acid, ortho-boric acid, tetra-boric acid, alkyl borate—including mono-, di-, or tri-$C_1$-$C_6$ alkyl borate are used in the reaction. Preferably, boric acid is employed as the source of boron. Boric acid may be prepared by methods that are well known in the art. It may also be purchased from suppliers such as Aldrich and Fisher Scientific.

Hydrocarbyl Polyol Reactant

In one embodiment, the hydrocarbyl polyol reactant includes hydrocarbyl polyol components and its derivatives, excluding esters, has at least three hydroxyl groups. More preferred, the hydrocarbyl polyol component has the following structure:

(III)

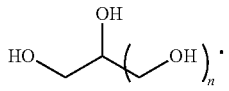

Wherein n is 1-2. Preferably, n is 1.

Examples of other hydrocarbyl polyols that may be employed in the present invention include the following:

(IV)

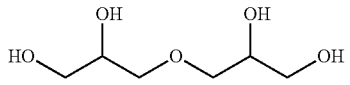

diglycerol

-continued (V)

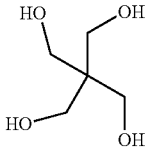

pentaerythritol

Method of Making the Lubricating Oil Additive Composition

The lubricating oil additive composition is prepared by charging a vessel with a nitrogen-containing reactant along with an aromatic solvent. Preferably, the nitrogen-reactant is bis-ethoxy alkylamine (which is also known as alkyl diethanolamine) or bis-ethoxy alkylamide. A source of boron, such as boric acid, is then added to the vessel. The mixture is refluxed until the water has been substantially removed to drive the reaction to completion and then an hydrocarbyl polyol having at least three hydroxyl groups, such as glycerol or pentaerythritol, is added to the mixture.

In one embodiment, the hydrocarbyl polyol having at least three hydroxyl groups is added to the vessel at the same time as the source of boron. The mixture is then refluxed for two hours.

Preferably the ratio of the nitrogen-containing reactant, the source of boron reactant and glycerol is from about 1:0.2:0.2 to 1:2.5:2.5. More preferred, the ratio is from about 1:0.2:0.2 to 1:1.5:1.5. Even more preferred, the ratio is from about 1:0.4:0.4 to 1:1:1. Most preferred, the ratio is from about 1:0.5:0.5 to 1:0.75:0.75.

Additive Concentrates

In many instances, it may be advantageous to form concentrates of the oil soluble additive composition of the present invention within a carrier liquid. These additive concentrates provide a convenient method of handling, transporting, and ultimately blending into lubricant base oils to provide a finished lubricant. Generally, the oil soluble additive concentrates of the invention are not useable or suitable as finished lubricants on their own. Rather, the oil soluble additive concentrates are blended with lubricant base oil stocks to provide a finished lubricant. It is desired that the carrier liquid readily solubilizes the oil soluble additive of the invention and provides an oil additive concentrate that is readily soluble in the lubricant base oil stocks. In addition, it is desired that the carrier liquid not introduce any undesirable characteristics, including, for example, high volatility, high viscosity, and impurities such as heteroatoms, to the lubricant base oil stocks and thus, ultimately to the finished lubricant. The present invention therefore further provides an oil soluble additive concentrate composition comprising an inert carrier fluid and from 2.0% to 90% by weight, based on the total concentrate, of an oil soluble additive composition according to the invention. The inert carrier fluid may be a lubricating oil.

These concentrates usually contain from about 2.0% to about 90% by weight, preferably 10% to 50% by weight of the oil soluble additive composition of this invention and may contain, in addition, one or more other additives known in the art and described below. The remainder of the concentrate is the substantially inert carrier liquid.

Lubricating Oil Compositions

In one embodiment of the invention, the oil soluble additive composition of the present invention can be mixed with a base oil of lubricating viscosity to form a lubricating oil composition. The lubricating oil composition comprises a major amount of a base oil of lubricating viscosity and a minor amount of the oil soluble additive composition of the present invention described above.

The lubricating oil which may be used in this invention includes a wide variety of hydrocarbon oils, such as naphthenic bases, paraffin bases and mixed base oils as well as synthetic oils such as esters and the like. The lubricating oils which may be used in this invention also include oils from biomass such as plant and animal derived oils. The lubricating oils may be used individually or in combination and generally have viscosity which ranges from 7 to 3,300 cSt and usually from 20 to 2000 cSt at 40° C. Thus, the base oil can be a refined paraffin type base oil, a refined naphthenic base oil, or a synthetic hydrocarbon or non-hydrocarbon oil of lubricating viscosity. The base oil can also be a mixture of mineral and synthetic oils. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

The lubricating oil compositions containing the oil soluble additives of this invention can be prepared by admixing, by conventional techniques, the appropriate amount of the oil soluble additives of the invention with a lubricating oil. The selection of the particular base oil depends on the contemplated application of the lubricant and the presence of other additives. Generally, the amount of the oil soluble additive of the invention in the lubricating oil composition of the invention will vary from 0.05 to 15% by weight, preferably from 0.1 to 1% by weight, and more preferred from about 0.1 to 0.8% by weight based on the total weight of the lubricating oil composition.

The lubricating oil composition may be used in passenger car engines, heavy duty diesel engines, natural gas engines, tractor hydraulic fluids, marine diesel engines, railroad diesel engines and the like.

Additional Additives

If desired, other additives may be included in the lubricating oil and lubricating oil concentrate compositions of this invention. These additives include antioxidants or oxidation inhibitors, dispersants, rust inhibitors, anticorrosion agents and so forth. Also, anti-foam agents, stabilizers, anti-stain agents, tackiness agents, anti-chatter agents, dropping point improvers, anti-squawk agents, extreme pressure agents, odor control agents and the like may be included.

The following additive components are examples of some of the components that can be favorably employed in the lubricating oil compositions of the present invention. These examples of additional additives are provided to illustrate the present invention, but they are not intended to limit it:

Metal Detergents

Detergents which may be employed in the present invention include alkyl or alkenyl aromatic sulfonates, metal salicylates, calcium phenate, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

Anti-Wear Agents

As their name implies, these agents reduce wear of moving metallic parts. Examples of such agents include, but are not limited to, zinc dithiophosphates, carbarmates, esters, and molybdenum complexes.

Rust Inhibitors (Anti-Rust Agents)

Anti-rust agents reduce corrosion on materials normally subject to corrosion. Examples of anti-rust agents include, but are not limited to, nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Other compounds useful as anti-rust agents include, but are not limited to, stearic acid and other alkyls, dicarboxylic acids, metal soaps, alkyl amine salts, metal salts of heavy sulfonic acid, partial carboxylic acid ester of polyhydric alcohol, and phosphoric ester.

Demulsifiers

Demulsifiers are used to aid the separation of an emulsion. Examples of demulsifiers include, but are not limited to, block copolymers of polyethylene glycol and polypropylene glycol, polyethoxylated alkylphenols, polyesteramides, ethoxylated alkylphenol-formaldehyde resins, polyvinylalcohol derivatives and cationic or anionic polyelectrolytes. Mixtures of different types of polymers may also be used.

Friction Modifiers

Additional friction modifiers may be added to the lubricating oil of the present invention. Examples of friction modifiers include, but are not limited to, fatty alcohols, alkyls, amines, ethoxylated amines, borated esters, other esters, phosphates, phosphites and phosphonates.

Multifunctional Additives

Additives with multiple properties such as anti-oxidant and anti-wear properties may also be added to the lubricating oil of the present invention. Examples of multifunctional additives include, but are not limited to, sulfurized oxymolybdenum dithiocarbamate, sulfurized oxymolybdenum organo phosphorodithioate, oxymolybdenum monoglyceride, oxymolybdenum diethylate amide, amine-molybdenum complexes, and sulfur-containing molybdenum complexes.

Viscosity Index Improvers

Viscosity index improvers, also known as viscosity modifiers, comprise a class of additives that improve the viscosity-temperature characteristics of the lubricating oil, making the oil's viscosity more stable as its temperature changes. Viscosity index improvers may be added to the lubricating oil composition of the present invention. Examples of viscosity index improvers include, but are not limited to, polymethacrylate type polymers, ethylene-propylene copolymers, styrene-isoprene copolymers, alkaline earth metal salts of phosphosulfurized polyisobutylene, hydrated styrene-isoprene copolymers, polyisobutylene, and dispersant type viscosity index improvers.

Pour Point Depressants

Pour point depressants are polymers that are designed to control wax crystal formation in lubricating oils resulting in lower pour point and improved low temperature flow performance. Examples of pour point depressants include, but are not limited to, polymethyl methacrylate, ethylene vinyl acetate copolymers, polyethylene polymers, and alkylated polystyrenes.

Foam Inhibitors

Foam inhibitors are used to reduce the foaming tendencies of the lubricating oil. Examples of foam inhibitors include, but are not limited to, alkyl methacrylate polymers, alkylacrylate copolymers, and polymeric organosiloxanes such as dimethylsiloxane polymers.

Metal Deactivators

Metal deactivators create a film on metal surfaces to prevent the metal from causing the oil to be oxidized. Examples of metal deactivators include, but are not limited to, disalicylidene propylenediamine, triazole derivatives, thiadiazole derivatives, bis-imidazole ethers, and mercaptobenzimidazoles.

Dispersants

Dispersants diffuse sludge, carbon, soot, oxidation products, and other deposit precursors to prevent them from coagulating resulting in reduced deposit formation, less oil oxidation, and less viscosity increase. Examples of dispersants include, but are not limited to, alkenyl succinimides, alkenyl succinimides modified with other organic compounds, alkenyl succinimides modified by post-treatment with ethylene carbonate or boric acid, alkali metal or mixed alkali metal, alkaline earth metal borates, dispersions of hydrated alkali metal borates, dispersions of alkaline-earth metal borates, polyamide ashless dispersants and the like or mixtures of such dispersants.

Anti-Oxidants

Anti-oxidants reduce the tendency of mineral oils to deteriorate by inhibiting the formation of oxidation products such as sludge and varnish-like deposits on the metal surfaces. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl).

Diphenylamine-type oxidation inhibitors include, but are not limited to, alkylated diphenylamine, phenyl-alpha-naphthylamine, and alkylated-alpha-naphthylamine Other types of oxidation inhibitors include metal dithiocarbamate (e.g., zinc dithiocarbamate), and methylenebis(dibutyldithiocarbamate).

Applications

Lubricating oil compositions containing the oil soluble additive compositions disclosed herein are effective as either fluid and grease compositions for modifying the friction properties of the lubricating oil which may, when used as a crankcase lubricant, lead to improved fuel economy for an engine being lubricated with a lubricating oil of this invention.

The lubricating oil compositions of this invention may be used in natural gas engine oils, marine cylinder lubricants as in crosshead diesel engines, crankcase lubricants as in automobiles and railroads, lubricants for heavy machinery such as steel mills and the like, or as greases for bearings and the like. Whether the lubricant is fluid or solid will ordinarily depend on whether a thickening agent is present. Typical thickening agents include polyurea acetates, lithium stearate and the like.

The following examples are presented to illustrate specific embodiments of this invention and are not to be construed in any way as limiting the scope of the invention

EXAMPLES

Example 1

Mixed Borate Ester of Bis-Ethoxy Oleylamine with Glycerol

A flask was charged with six grams of bis-ethoxy oleylamine and 10 milliliters of toluene. 1.04 grams of boric acid were added to the solution. The mixture was refluxed for two hours and then 1.54 grams of glycerol were added to the flask. The bis-ethoxyl olelyamine, boric acid and glycerol were added at a ratio of 1:1:1. Refluxing was continued overnight. Toluene was removed under reduced pressure to obtain the product.

Alternatively, the glycerol can be added when the boric acid addition is made. This mixture is refluxed overnight. Toluene is removed under reduced pressure to obtain the product.

Examples 2-4

Mixed Borate Ester of Bis-Ethoxy Cocamide with Glycerol

A mixture was prepared according to Example 1. Bis-ethoxy cocamide was substituted for bis-ethoxy oleylamine in the reaction. Additionally, a number of different ratios of bis-ethoxy cocamide to glycerol to boric acid were synthesized. Ratios include 2:1:1, 1:1:1, and 1:2:2 of bis-ethoxy cocamide to glycerol to boric acid.

Example 5

Dipropxoylated Oleylamine with Glycerol

A flask was charged with 100 grams of Propylmeen O/12 which was purchased from Akzo Nobel, 24.2 g of boric acid, and 36.2 g of glycerol at 1.0:1.5:1.5 equivalents, respectively. The mixture was heated to 110° C., held for three hours under house vacuum and a nitrogen blanket. A dean stark trap was used to collect water. The product was tested in the Mazda screener.

Example 6

Polypropoxylated Bisethoxy Cocamide with Glycerol

A flask was charged with 50 g of polypropxylated bisethoxy cocamide, 3.87 g of boric acid, and 5.75 g of glycerol at 1:0.75:0.75 equivalents, respectively. The mixture was heated to 110° C., held for three hours under house vacuum and a nitrogen blanket. A dean stark trap was used to collect water. At the end of the reaction, the product was tested in the Mazda screener.

Example 7

Diethanolamide Derived from Coconut Oil, Boric Acid, Pentaerythritol

A flask was charged with 50 grams of diethanolamide derived from coconut oil, 5.06 g of boric acid, and 11.16 g of pentaerythritol at 1.0:0.5:0.5 equivalents, respectively. The mixture was heated to 110° C., held for three hours under house vacuum and a nitrogen blanket. A dean stark trap was used to collect water. The product was tested in the Mazda screener.

Example A

Comparative

Mixed Borate Ester of Bis-Ethoxy Oleylamine with Butanol

A mixture was prepared according to Example 1. Butanol was substituted for glycerol in the reaction.

Example B

Comparative

Mixed Borate Ester of Bis-Ethoxy Cocamide with 1-Hexanol

A mixture was prepared according to Example 1. Bis-ethoxy cocamide was substituted for the amine reactant and 1-hexanol was used instead of glycerol.

Example C

Comparative

Mixed Borate Ester of Bis-Ethoxy Oleylamine with 1-Hexanol

A mixture was prepared according to Example 1. 1-hexanol was used instead of glycerol.

Example D

Comparative

Bis-Ethoxy Cocamide No Alcohol

A flask was charged with six grams of bis-ethoxy cocamide and 10 milliliters of toluene. 1.04 grams of boric acid were added to the solution. The mixture was refluxed for two hours. Toluene was removed under reduced pressure to obtain the product.

Example E

Comparative

Bis-ethoxy Tallowamine No Alcohol Co-Boration

A mixture was prepared according to Comparison Example D. Bis-ethoxy tallowamie was used instead of bis-ethoxy cocamide.

Example F

Comparative

Example F is Propylmeen O/12 (propoxylated amine)

Example G

Comparative

Example G is polypropoxylated diethanolamide.

Example H

Comparative

Example H is diethanolamide derived from coconut oil.

Results of the Mazda test screener for Examples 1-7 and Comparative Examples A-H are compiled in Table 5.

Friction Reduction Measured by Mini-Traction Machine

The lubricating oil additives prepared in Examples 1 and 3 and in Comparative Examples A-C were evaluated for friction reducing properties under a Mini-Traction Machine (MTM) bench test.

Two baselines were tested using a bench tribometer. Within each baseline all lubricants tested contained identical amounts of additives, exclusive of a friction modifier, (the "baseline additive package") including dispersant, detergents, zinc dialkyldithiophosphate, antioxidant, polymethacrylate pour point depressant, and olefin copolymer viscosity index improver.

The friction modifiers of the invention (Examples 1-3) and of the comparative examples (Comparative Examples A-C) were added at a treat rate of 1% by weight. The compositions described above were tested for friction performance in a Mini-Traction Machine (MTM) bench test. The MTM is manufactured by PCS Instruments and operates with a ball (0.75 inches in diameter 8620 steel ball) loaded against a rotating disk (52100 steel). The conditions employ a load of approximately 10-30 Newtons, a speed of approximately 10-2000 mm/s and a temperature of approximately 125-150° C. In this bench test, friction performance is measured as the total area under the second Stribeck curve generated. Lower total area values correspond to better friction performance.

TABLE 1

Friction Modifier Used in Passenger Car Engine Oil

| Friction Modifier | MTM Result |
|---|---|
| Example 1 | 57 |
| Comparative Example A | 79.5 |

When used in a passenger car engine oil, the lubricating oil composition formulated with the friction modifier of the invention (Example 1) has better friction reduction than that of the lubricating oil composition formulated with a known mixed borate ester (Comparative Example A).

TABLE 2

Friction Modifier Used in Heavy Duty Diesel Engine Oil:

| Friction Modifier | MTM Result |
|---|---|
| Example 3 | 105 |
| Comparative Example B | 122 |
| Comparative Example C | 132 |

When used in a heavy duty diesel engine oil, Table 2 shows that the lubricating oil composition formulated with the friction modifier of the invention (Example 3) has better friction reduction than that of a lubricating oil composition formulated with a known mixed borate ester (Comparative Examples B and C).

Comparative Example I

Polynitrogenamide Glycerol Borate

Preparation:

A flask was charged with 5.2 grams of isostearic acid, 4 grams of N,N-BIS(2-hydroxyethyl)ethylendiamine dihydrochloride and 2.5 g of $K_2CO_3$ at 1.0:1.0:1.0 equivalents, respectively. The mixture was heated to 150° C., held overnight under a water condenser and a nitrogen blanket. The reaction mixture was then diluted with ethyl acetate and washed with brine, dried with sodium sulfate, and rotovaped to obtain the resulting product.

Example 9

A flask was charged with 2 g of the product in Example 8, 0.22 g of boric acid and 0.33 g of glycerol at 1.0:0.75:0.75 equivalents, respectively. The mixture was heated to 110° C., held for three hours under a nitrogen blanket. At the end of the reaction, the product was collected and analyzed in the Mini-Traction Machine.

Comparative Example I and Example 9 were evaluated in the MTM. The results are summarized in Table 3.

TABLE 3

| Component | Comparative Example I | Example 9 |
|---|---|---|
| Treat Rate (%) | 0.50% | 0.50% |
| Average of Runs | 118.25 | 105.4 |

Example 10

A flask was charged with 50.76 grams of Ethoduomeen T/13, 3.35 grams of boric acid, and 5.04 grams of glycerol at 1.0:0.5:0.5 equivalents, respectively. The mixture was heated to 110° C. and held for three hours under house vacuum and a nitrogen blanket. A dean stark trap was used to collect water. At the end of the reaction, the product was evaluated in the MTM.

Ethoduomeen may be purchased from Akzo Nobel and has the following structure:

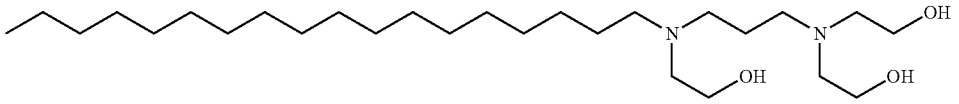

Ethoduomeen T/13 (Comparative Example 10) was also evaluated in the MTM.

TABLE 4

| Component | Comparative Example J | Example 10 |
|---|---|---|
| Treat Rate (%) | 0.50% | 0.50% |
| Average of Runs | 129.11 | 122.86 |

Mazda Screener

The lubricating oil additives prepared in Examples 2-4 and in Comparative Example D were evaluated for fuel economy properties in the Mazda Screener.

All formulated lubricating oil compositions contained identical amounts of additives, exclusive of a friction modifier, (the "baseline additive package") including dispersant, detergents, zinc dialkyldithiophosphate, antioxidant, polymethacrylate pour point depressant, and olefin copolymer viscosity index improver. Friction modifiers, of the invention and comparative examples, were added as a top treat to this baseline formulation of 1 wt % with the exception of Example 4 which was added as a top treat of 0.5 wt %.

The fuel economy performance of lubricating oil compositions containing different organic friction modifiers was evaluated. A V-6 2.5 L engine was adjusted to run at a rotational speed of 1400 r/min and a temperature of about 107-120° C. Three high detergent oil flushes were first run through the engine for twenty minutes each. The engine was then operated for two hours with a lubricant which contained the baseline lubricant formulation without a friction modifier. After two hours, thirty grams of a lubricating oil containing the baseline additive package was top treated with 0.5 wt % of the friction modifier and was added to the engine through a specially adapted oil fill cap. The engine was allowed to stabilize for two hours.

The brake specific fuel consumption (BSFC) was evaluated by averaging the BSFC for a period of one hour prior to the addition of the top treated lubricating oil composition and averaging the BSFC for a period of two hours immediately following the addition of the top treated lubricating oil composition. Results are reported as the change in BSFC between the BSFC of the one hour before the addition of the top treated lubricating oil composition and the BSFC of the two hours after the addition of the top treated lubricating oil composition. Results are reported as an average of two runs. A more

TABLE 5

| Ex. | Nitrogen-containing reactant | Alcohol | Boron Source | Parts Nitrogen,-containing reactant | Parts Alcohol | Parts Boron | Mazda Performance | Mazda Performance |
|---|---|---|---|---|---|---|---|---|
| | | | | | | | Treat Rate (0.5%) | Treat Rate (1%) |
| 1 | Bis-ethoxy oleylamine | Glycerol | Boric Acid | | | | | |
| 2 | Bis-ethoxy Cocamide | Glycerol | Boric Acid | 1 | 0.5 | 0.5 | — | −1.90% |
| 3 | Bis-ethoxy Cocamide | Glycerol | Boric Acid | 1 | 1 | 1 | — | −2.03% |
| 4 | Bis-ethoxy Cocamide | Glycerol | Boric Acid | 1 | 2 | 2 | −1.43% | — |
| 5 | Propylmeen Propoxylated Amine | Glycerol | Boric Acid | 1 | 1.5 | 1.5 | | −1.80% |
| 6 | Poly-propoxylated Diethanol-amide | Glycerol | Boric Acid | 1 | 0.75 | 0.75 | | −1.36% |
| 7 | OGA diethanol-amide | Penta-erythritol | Boric Acid | 1 | 0.5 | 0.5 | | −1.49% |
| A (Comp.) | Bis-ethoxy oleylamine | Butanol | Boric Acid | | | | | |
| B (Comp.) | Bis-ethoxy Cocamide | 1-hexanol | Boric Acid | | | | | |
| C (Comp.) | Bis-ethoxy oleylamine | 1-hexanol | Boric Acid | | | | | |
| D (Comp.) | Bis-ethoxy cocamide | None | Boric Acid | | | | | |
| E (Comp.) | Bis-ethoxy tallowamine | None | Boric Acid | | | | | |
| F (Comp.) | Propylmeen (propoxylated amine) | None | None | | | | | −0.21% |
| G (Comp.) | Poly-Propoxylated amide | None | None | | | | | −1.08% |
| H (Comp.) | Diethanolamide derived from coconut oil | None | None | | | | −1.26% | −1.65% |

negative value corresponds to higher fuel economy benefit. The results of this evaluation are shown in the table below.

TABLE 6

| Brake Specific Fuel Consumption | | |
|---|---|---|
| Friction Modifier | Brake Specific Fuel Consumption (BSFC) Treat Rate (1%) | Brake Specific Fuel Consumption (BSFC) Treat Rate (0.5%) |
| Example 2 | −1.90% | — |
| Example 3 | −2.01% | — |
| Example 4 | — | −1.43% |
| Comparative Example D | −1.65% | −1.26% |

It is interesting to note that varying the ratio between components in the mixed borate ester changes the fuel savings. It appears that Example 4 would have the best fuel economy overall if measured at a 1% treat rate.

The lubricating oil compositions top treated, at 0.5% and 1% treat rates, with the mixed borate esters of the invention show improved fuel economy over that of the lubricating oil composition top treated with known friction modifier—Comparative Example D.

D12D FE

The lubricating oil additives prepared in Examples 1 and 3 and in Comparative Example E were evaluated for fuel economy benefits in a diesel engine oil when using the friction modifier of the present invention and the comparative friction modifier.

All lubricating oil compositions that were tested contained identical amounts of additives, exclusive of a friction modifier, (the "baseline additive package") including dispersant, detergents, zinc dialkyldithiophosphate, antioxidant, polymethacrylate pour point depressant, and olefin copolymer viscosity index improver.

Two friction modifiers of the invention were added to the baseline lubricating oil composition at a top treat of 1% by weight. The comparative friction modifier was added to the baseline lubricating oil composition was added at a top treat of 2% by weight.

The lubricating oil compositions described above were tested for fuel economy performance according to the Volvo D12D Fuel Economy (D12DFE) engine test procedure (see W. van Dam, P. Kleijwegt, M. Torreman, and G. Parsons "The Lubricant Contribution to Improved Fuel Economy in Heavy Duty Diesel Engines" SAE Paper 2009-01-2856).

TABLE 7

| Fuel Economy: Friction Modifier in an Engine Oil Used in a Diesel Engine | | |
|---|---|---|
| Friction Modifier | Hilly Terrain | Flat Terrain |
| Example 1 | −0.44% | −0.53% |
| Example 3 | −0.24% | −0.28% |
| Comparative Example E | 0% | −0.06% |

Under D12D FE, a more negative value corresponds to a higher fuel economy benefit. The lubricating oil compositions formulated with friction modifiers of the invention (Examples 1 and 3) show a significant improvement, with regard to fuel economy in both hilly and flat terrain, over lubricating oil compositions formulated with a known friction modifier bis-ethoxy tallowamine (Comparative Example E) that has not been reacted with glycerol and boric acid.

What is claimed is:

1. A lubricating oil additive composition comprising the reaction product of a (a) first reactant being a nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester, (b) a second reactant being a source of boron, and (c) a third reactant being a hydrocarbyl polyol, having at least three hydroxyl groups.

2. The lubricating oil additive composition of claim 1 wherein the nitrogen-containing reactant is an alkyl alkanolamide, an alkyl alkoxylated alkanolamide, an alkyl alkanolamine, an alkyl alkoxylated alkanolamine or mixtures thereof comprises a bis-ethoxy alkylamine or a bis-ethoxy alkylamide.

3. The lubricating oil additive composition of claim 2 wherein the alkyl group in the bis-ethoxy alkyl amine comprises oleyl, dodecyl, or 2-ethylhexyl.

4. The lubricating oil additive composition of claim 2 wherein the alkyl group in the bis-ethoxy alkyl amide is derived from coconut oil.

5. The lubricating oil additive composition of claim 1 wherein the source of boron is boric acid.

6. The lubricating oil additive composition of claim 1 wherein the hydrocarbyl polyol comprises glycerol or pentaerythritol.

7. A lubricating oil composition comprising

A. major amount of an oil of lubricating viscosity and

B. a lubricating oil additive composition comprising the reaction product of (i) a first reactant being a nitrogen-containing reactant, wherein the nitrogen-containing reactant comprises an alkyl alkanolamide, an alkyl alkoxylated alkamlamide, an alkyl alkanolamine, an alkyl alkoxylated alkanolamine or mixtures thereof, and wherein the nitrogen-containing reactant contains less than 10 mass percent of glycerol alkyl ester, (ii) a second reactant being a source of boron, and (iii) a third reactant being a hydrocarbyl polyol, having at least three hydroxyl groups.

8. The lubricating oil additive composition of claim 7 wherein the nitrogen-containing reactant is an alkyl alkanolamide, an alkyl alkoxylated alkanolamide, an alkyl alkanolamine, an alkyl alkoxylated alkanolamine or mixtures thereof is a bis-ethoxy alkyl amine or a bis-ethoxy alkyl amide.

9. The lubricating oil composition of claim 8 wherein the alkyl group in the bis-ethoxy alkyl amine comprises oleyl, dodecyl, or 2-ethylhexyl.

10. The lubricating oil composition of claim 8 wherein the alkyl group in the bis-ethoxy alkyl amide is derived from coconut oil.

11. The lubricating oil composition of claim 6 wherein the source of boron comprises boric acid.

12. The lubricating oil composition of claim 6 wherein the hydrocarbyl polyol comprises glycerol or pentaerythritol.

13. A method for reducing friction in an internal combustion engine comprising lubricating said engine with a lubricating oil composition comprising the lubricating oil composition in claim 7.

14. A lubricating oil additive concentrate comprising from about 90 wt. % to about 10 wt. % of an organic liquid diluent and from about 10 wt. % to about 90 wt. % of the lubricating oil additive composition of claim 1.

15. A method of preparing a lubricating oil additive composition comprising reacting (a) a first reactant being a nitrogen-containing reactant, wherein the nitrogen-containing reactant comprises an alkyl alkanolamide, an alkyl alkoxylated alkanolamide, an alkyl alkanolamine, an alkyl alkoxylated alkanolamine or mixtures thereof, and wherein the nitrogen-containing reactant contains less than 10 mass percent of glycerol alkyl ester, (b) a second reactant being a source of boron, and (c) a third reactant being a hydrocarhyl polyol, having at least three hydroxyl groups.

16. The method of claim 15 wherein the ratio of the nitrogen-containing reactant, the source of boron, and the hydrocarbyl polyol is a mole ratio from about 1:0.2:0.2 to about 1:2.5:.5, respectively.

17. The method of claim 15 wherein the nitrogen-containing reactant is an alkyl alkanolamide, an alkyl alkoxylated alkanotamide, an alkyl alkanolamine, an alkyl alkoxylated alkanolamine or mixtures thereof is a bis-ethoxy alkylamine or a bis-ethoxy alkylamide.

18. The lubricating oil additive composition of claim 17 wherein the alkyl group in the bis-ethoxy alkyl amine comprises oleyl, dodecyl, or 2-ethylhexyl.

19. The lubricating oil additive composition of claim 17 wherein the alkyl group in the bis-ethoxy alkyl amide is derived from coconut oil.

20. The lubricating oil additive composition of claim 1 wherein the source of boron comprises boric acid.

21. The lubricating oil additive composition of claim 1 wherein the hydrocarbyl polyol comprises glycerol or pentaerythritol.

22. The lubricating oil additive composition of claim 1, wherein the hydrocarbyl polyol third reactant excludes esters.

23. The lubricating oil composition of claim 7 wherein the hydrocarbyl polyol third reactant excludes esters.

24. The method of claim 15, wherein the hydrocarbyl polyol third reactant excludes esters.

* * * * *